US006689040B2

(12) United States Patent
Ifkovits et al.

(10) Patent No.: US 6,689,040 B2
(45) Date of Patent: Feb. 10, 2004

(54) RIGHT ANGLE TURNING DEVICE FOR AN INSERTER SYSTEM AND CORRESPONDING METHOD

(75) Inventors: Edward M Ifkovits, New Fairfield, CT (US); Eric Janatka, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/474,329

(22) Filed: Dec. 29, 1999

(65) Prior Publication Data

US 2003/0022780 A1 Jan. 30, 2003

(51) Int. Cl.[7] ..... B31F 1/00

(52) U.S. Cl. ..... 493/419; 493/405; 493/420; 271/184; 271/225

(58) Field of Search ..... 493/11, 419–420, 493/421, 405; 271/225, 271, 184

(56) References Cited

U.S. PATENT DOCUMENTS 1,832,988 A * 11/1931 Kleinschmit et al.
1,833,296 A * 11/1931 Mentges
2,414,386 A * 1/1947 Olson ..... 270/68
2,665,633 A * 1/1954 Schubert (List continued on next page.)

OTHER PUBLICATIONS

Specification of U.S. patent application Ser. No. 09/473,418, filed Dec. 29, 1999, entitled "Multi–Path Right Angle Turning Device for an Inserter System".

*Primary Examiner*—Rinaldi I. Rada
*Assistant Examiner*—Thanh Truong
(74) *Attorney, Agent, or Firm*—Michael J. Cummings; Charles R. Malandra, Jr.; Angelo N. Chaclas

(57) ABSTRACT

An apparatus, and corresponding method, for accumulating and directionally reorienting the movement of a stack of sheets after first folding the stack, each sheet of the stack being fed from a feed conveyor along a feed path. The apparatus includes a turnplate, for receiving each of a series of sheets which are there accumulated into a stack of sheets. Stops protrude from a sheet-receiving surface of the turnplate, which holds the stack of sheets edge aligned against the stops. The apparatus also includes a chute pusher disposed so as to have a pusher tab movable across the sheet-receiving surface of the turnplate, for pushing the stack of sheets along the sheet-receiving surface of the turnplate in a chute direction at substantially ninety degrees from the feed path; a chute feed nip, disposed at the edge of the turnplate toward which the pusher tab pushes, for grabbing the stack of sheets and driving it onward in the chute direction; a chute, disposed so as to receive the stack of sheets being provided in the chute direction by the chute feed nip, the chute having a chute stop disposed a distance along the chute approximately equal to a half-width of the stack of sheets, for continuing to receive the stack until it stops at the chute stop and then to provide a buckle in the stack that is caused to protrude from the chute under the continuing action of the chute feed nip, until the stack is clear of the chute feed nip; a folder nip, disposed to grab the buckle in the stack, for providing the stack folded in half; and a diverter, rotatably disposed to receive the stack folded in half, for directing the stack to either of two different directions, depending on the orientation of the diverter. In addition, it includes a sensor such as a bar code reader for sensing information about directing the stack to either of the two different directions.

14 Claims, 8 Drawing Sheets

U.S. PATENT DOCUMENTS 3,796,862 A * 3/1974 Asija ..... 235/61.11
4,388,994 A * 6/1983 Suda et al. ..... 209/564
4,909,374 A * 3/1990 Skrypalle ..... 198/371.3
4,938,467 A 7/1990 Honjo et al.
5,045,039 A 9/1991 Bay
5,054,757 A 10/1991 Martin et al.
5,242,368 A * 9/1993 Buckley et al. ..... 493/421
5,261,994 A * 11/1993 Goodfellow ..... 156/396
5,269,744 A * 12/1993 Moll ..... 493/421
5,344,379 A * 9/1994 Garrone ..... 493/441
5,360,213 A 11/1994 Crowley et al.
5,374,052 A * 12/1994 Folsom ..... 271/225
5,397,292 A 3/1995 Deckers et al.
5,551,939 A * 9/1996 Deckers ..... 493/442
5,641,158 A 6/1997 Gelb, Jr. et al. ..... 271/225
5,697,880 A 12/1997 Auerbach
5,713,718 A * 2/1998 Okura et al. ..... 414/797.9
5,769,774 A * 6/1998 Beck et al. ..... 493/421
5,833,232 A 11/1998 Ifkovits et al. ..... 271/225
6,086,522 A 7/2000 Hechler
6,206,817 B1 3/2001 Sette et al.

* cited by examiner

RIGHT ANGLE TURNING DEVICE FOR AN INSERTER SYSTEM AND CORRESPONDING METHOD

CROSS-REFERENCE TO RELATED PATENTS

U.S. Pat. Nos. 5,641,158, GELB, IFKOVITS & STENGL (1997), and U.S. Pat. No. 5,833,232, IFKOVITS, JANATKA, STENGL & ZUZICK (1998), the disclosures of which are hereby incorporated by reference.

TECHNICAL FIELD

The present invention relates generally to machinery for assembling multi-sheet mailing pieces and inserting them into envelopes and, more particularly, to an improved right-angle-turning (RAT) device adapted for use in such a mailing system.

BACKGROUND OF THE INVENTION

A production mailing system typically includes a series of modules which perform different functions, such as a cutter (for slicing a continuous paper web into sheets) or a burster (for separating a paper web having transverse perforations into sheets), an accumulator for accumulating all the sheets intended for a particular recipient, and an inserter for putting the collected sheets into an envelope. Frequently, a right-angle-turning (RAT) module will be placed between the accumulator and the inserter. However, conventional right-angle-turners are insufficiently versatile in coping with over-sized or otherwise irregular collections of sheets.

SUMMARY OF THE INVENTION

Accordingly, it is an object of the present invention to provide an improved right-angle-turner which can selectively divert oversized or irregular sets of sheets out of a primary or standard paper path into a secondary paper path for special handling, in order to minimize paper jams and consequent downtime. Preferably, the device also folds each set of sheets.

Briefly, this diversion is accomplished by an apparatus and corresponding method, the apparatus including: a receiving means, for receiving the sheet and redirecting it in a chute direction at substantially ninety degrees from the feed path; a chute means, for grabbing the redirected sheet and for causing the sheet to form a buckle along a line located at approximately halfway across a width of the sheet and extending along a length of the sheet; a folder nip, disposed to grab the buckle in the sheet, for providing the sheet folded in half; and a diverter, rotatably disposed to receive the sheet folded in half, for directing the sheet to either of at least two final directions, depending on its orientation.

In a further aspect of the invention, the chute means includes: a chute feed nip, disposed at the edge of the turnplate toward which the pusher tab pushes, for grabbing the sheet and driving it onward in the chute direction; and a chute, disposed so as to receive the sheet being provided in the chute direction by the chute feed nip, the chute having a chute stop disposed a distance along the chute approximately equal to a half-width of the sheet, for continuing to receive the sheet until it stops at the chute stop and then to provide a buckle in the sheet that is caused to protrude from the chute under the continuing action of the chute feed nip, until the sheet is clear of the chute feed nip.

In a still further aspect of the invention, the receiving means includes: a turnplate for receiving the sheet, the turnplate having stops protruding from a sheet-receiving surface of the turnplate, for holding the sheet edge aligned against the stops; and a chute pusher disposed so as to have a pusher tab movable across the sheet-receiving surface of the turnplate, for pushing the sheet along the sheet-receiving surface of the turnplate in a chute direction at substantially ninety degrees from the feed path.

In another aspect of the invention, the apparatus also includes a means for acquiring information about whether to divert the sheet, and the diverter is rotated into an orientation depending on the acquired information. In particular, the means for acquiring information can be a bar code reader that scans the sheet to determine to which final path to direct the sheet.

The present invention accomplishes all of the above processing not only on a single sheet by single sheet basis, but for stacks of sheets that it forms by accumulating a series of sheets being provided over the feed path. In case of processing a stack of sheets, the entire stack is folded, i.e. the sheets are folded collectively, as a stack.

DETAILED DESCRIPTION

Figure 1A:
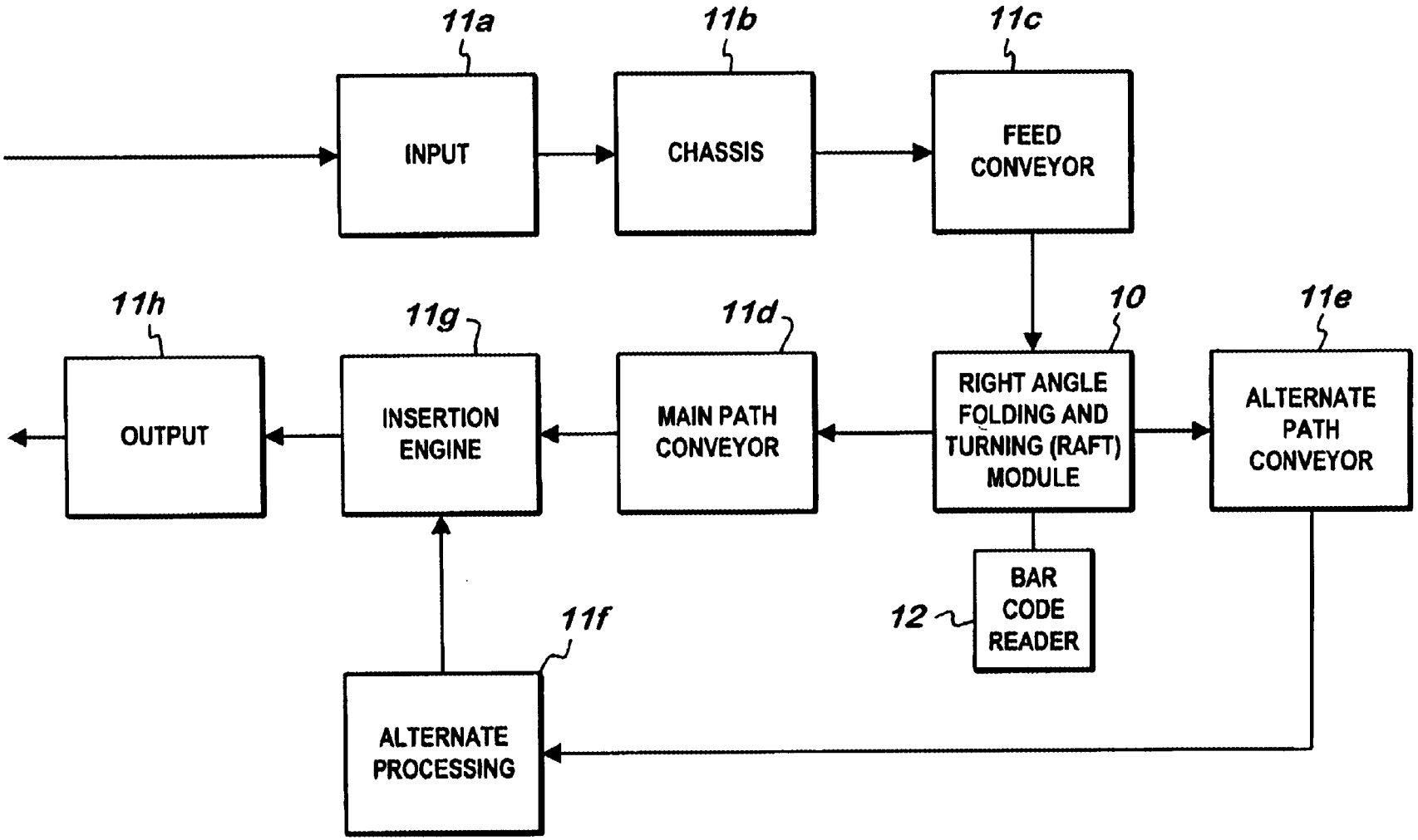
FIG. 1A is a block diagram showing the present invention in the larger context of a mailing system.

Referring now to FIG. 1*a,* a right-angle folding and turning (RAFT) module 10 according to the present invention is shown in the larger context of a mailing system, including an input module 11*a* that inputs and preferably collates sheets of a mail piece; a chassis 11*b* that accepts the sheets and may insert additional sheets; a feed conveyor 11*c* that feeds the sheets including any additional sheets (inserts) to the RAFT module 10. Except for sheets that are indicated (by for example a bar code) to require alternate processing, the RAFT module 10 provides the sheets, stacked and folded, to a main path conveyor 11*d* that then conveys the sheets to an insertion engine 1*g*. Those sheets that are indicated as irregular and so as requiring alternate processing are provided by the RAFT device 10 to an alternate path conveyor 11*e* that then provides the irregular sheets to an alternate processing module 11*f*, from which the irregular sheets are then provided to the insertion engine 11*g*. The insertion engine inserts the sheets into an envelope, providing stuffed envelopes to an output module 11*h* typically at a rate of 5 envelopes per second. The output module 11*h* seals, weighs, stacks and adds indicia to the stuffed envelopes.

Figure 1B:
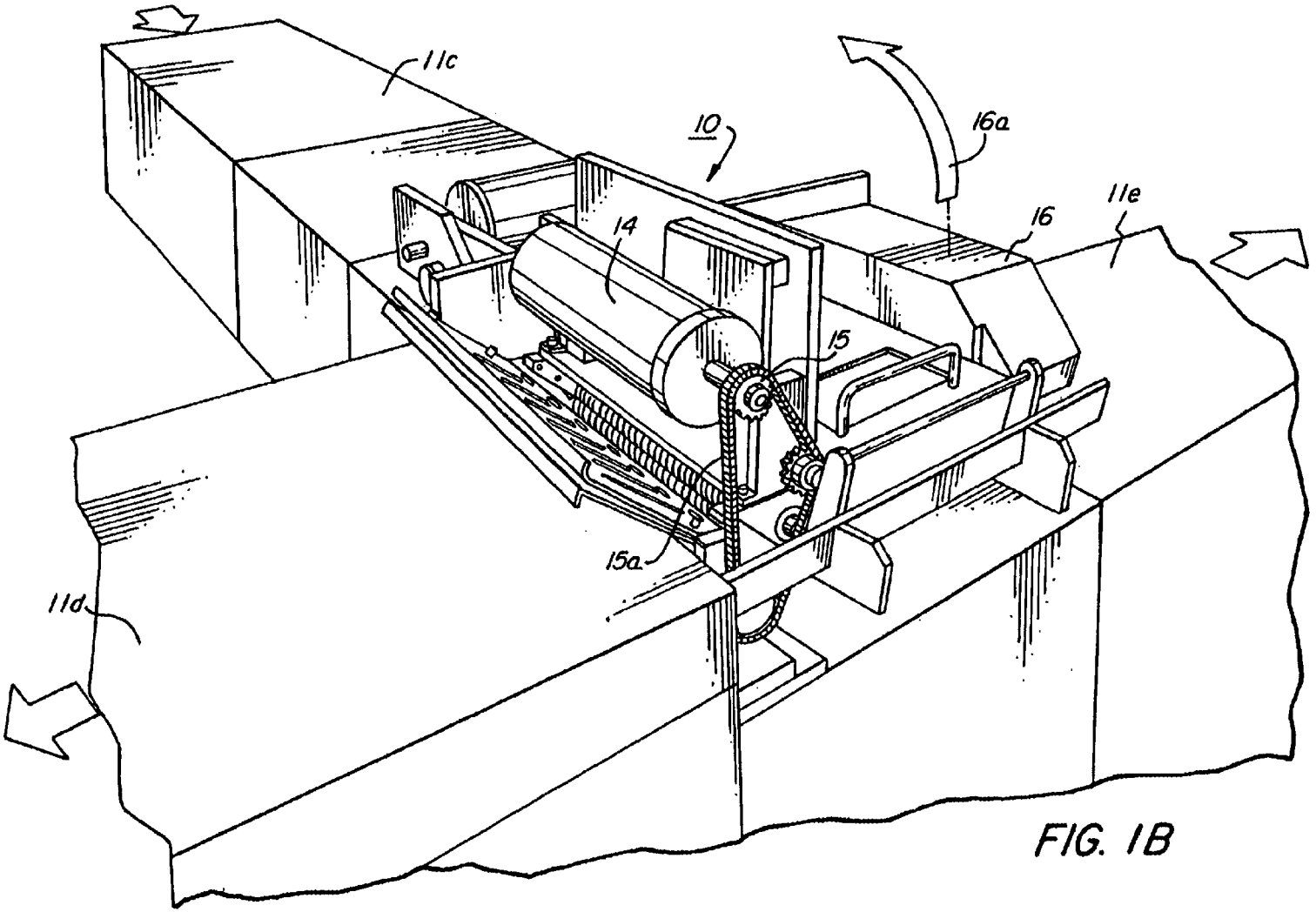
FIG. 1B is a perspective view of a right angle folding and turning (RAFT) device according to the present invention, viewed in its operational configuration (with its access panel closed)

Referring now to FIG. 1*b*, the RAFT module is generally indicated as reference numeral 10 and is shown being fed by feed conveyor 11*c*, and providing sheets to either the main path conveyor 11*d*, or the alternate path conveyor 11*e*. The sheets provided to either the main path conveyor 11*d* or the alternate path conveyor 1*e* are folded, as will be described below. A bar code reader 12 (FIG. 1*a*), not shown, instructs the RAFT 10 whether to fold a stack of sheets and provide the folded stack to the main path conveyor 11*d*, or to provide a folded stack of sheets to the alternate path conveyor 11*e*. An access panel 16 can be lifted as shown by arrow 16*a* so as to provide access to the inside of the RAFT module 10. The RAFT module includes a drive motor 14, which is typically a stepper motor, that provides torque to a drive gear 15, which then transmits the torque by a belt 15*a* to other gears connected to nips used in grabbing the stack for further processing, as will be described below.

Figure 2:
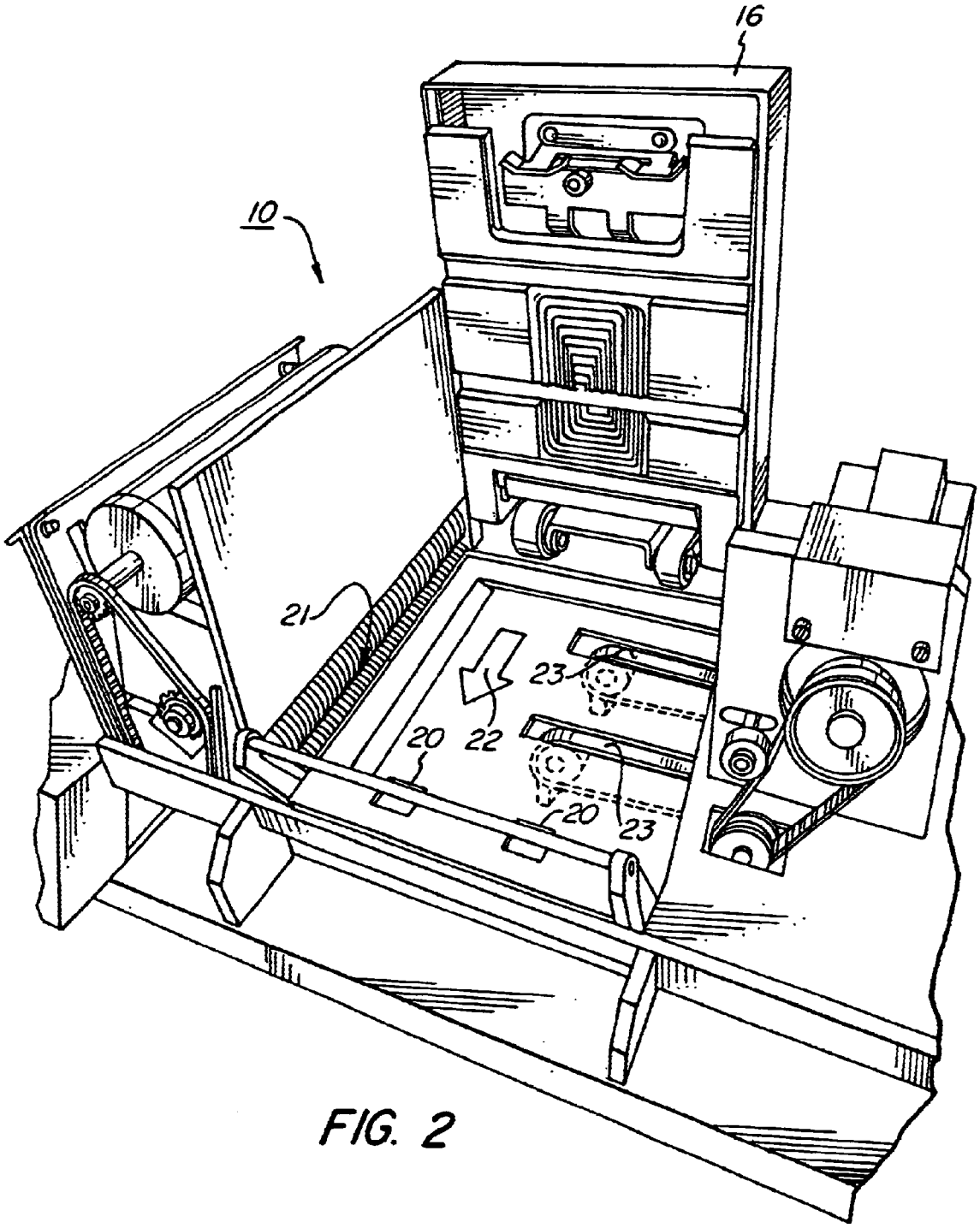
FIG. 2 is a perspective view of the inside of the RAFT device.

Referring now to FIG. 2, the access panel 16 is shown in the open position allowing access to the inside of the RAFT module 10. Sheets are provided by the feed conveyor 11*c* (FIG. 1*b*) shown by the arrow 22. The sheets are propelled, as will be described below, until hitting stops 20. The sheets accumulate until all of the sheets that are to be folded together, i.e. as a stack, rest on the stops 20. Then chute pushers 23 direct the stack of sheets toward a fold nip 21, after which the stack of sheets is folded, as will be described below.

Figure 3:
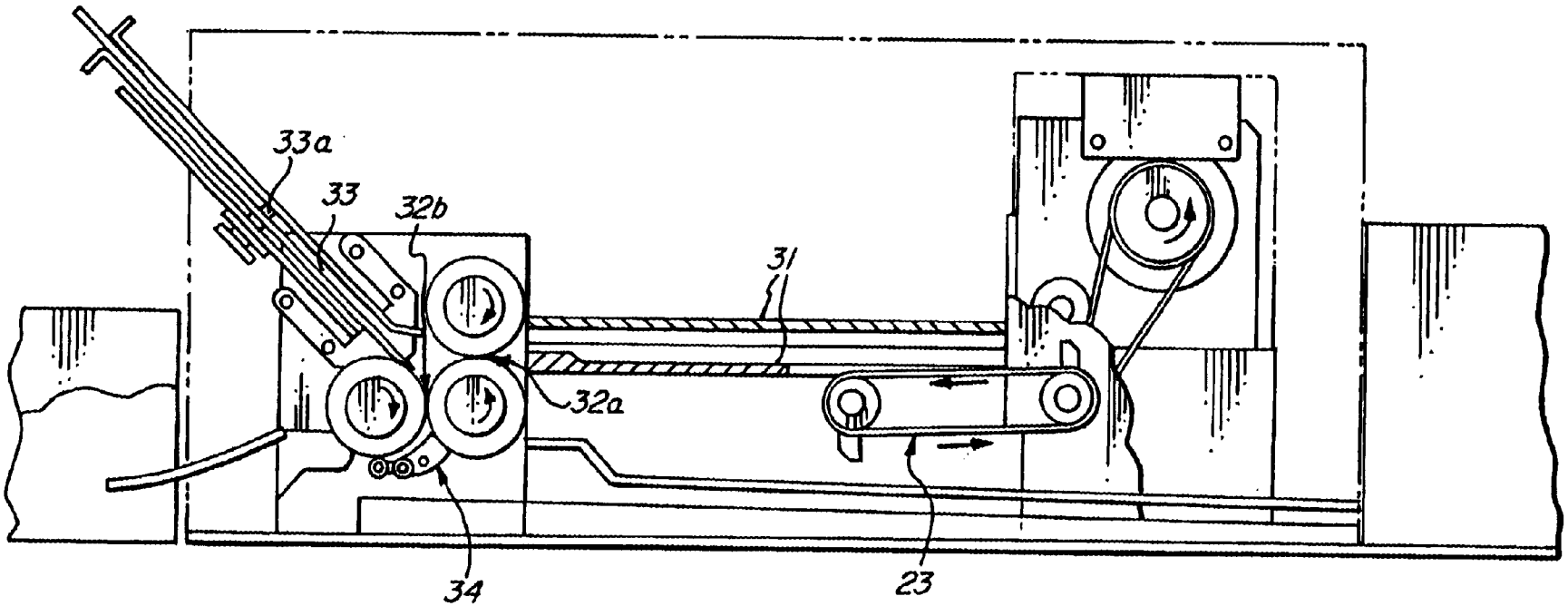
FIG. 3 is a cross sectional side view of the inside of the RAFT device.
Figure 4:
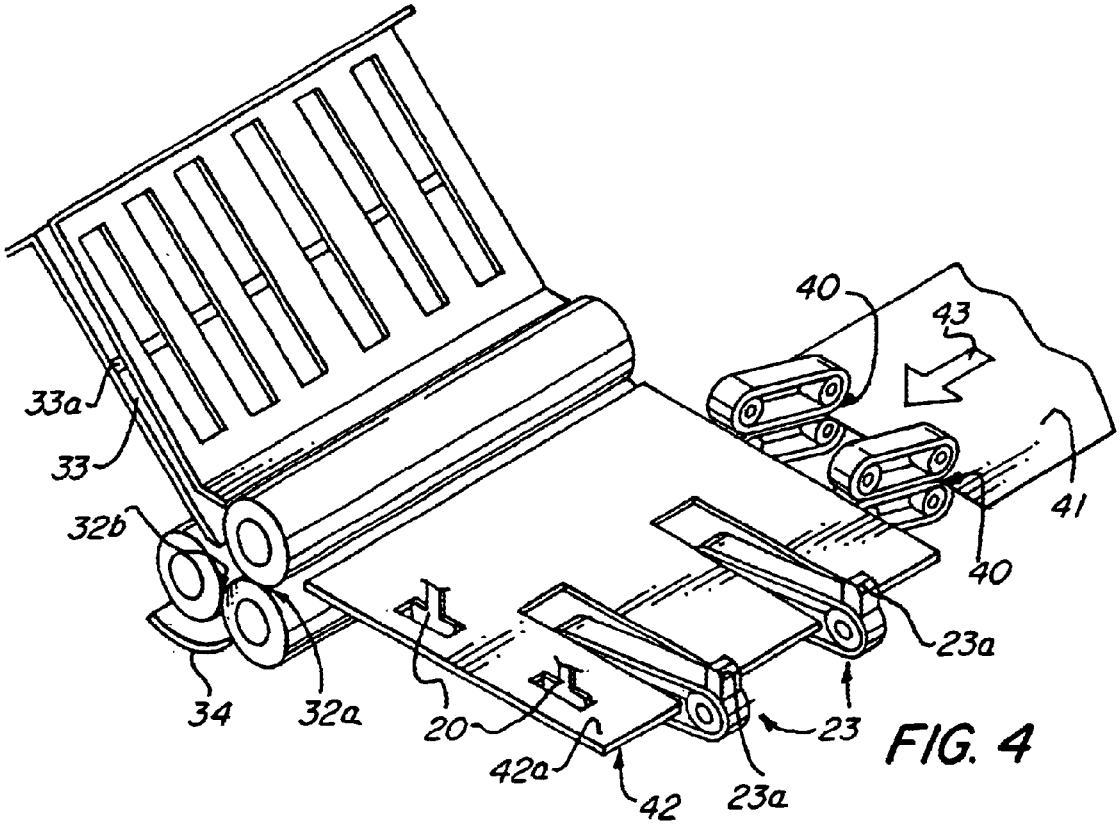
FIGS. 4–9 illustrate the folding and turning of sheets by the RAFT device.
Figure 5:
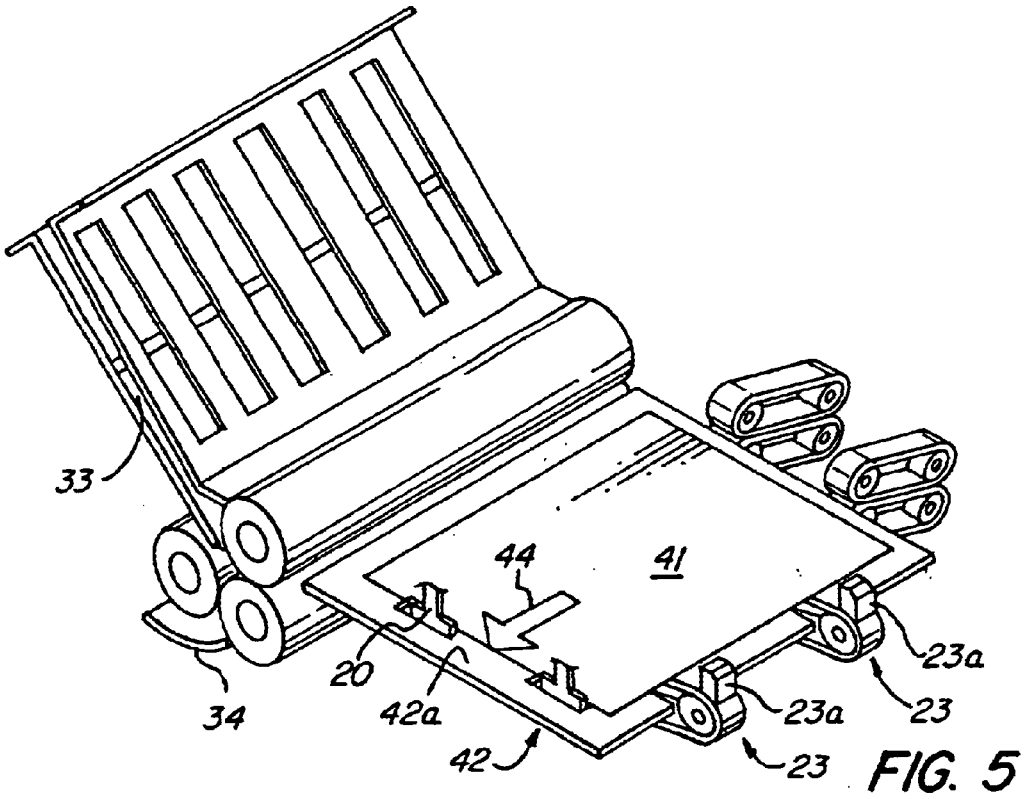
Figure 6:
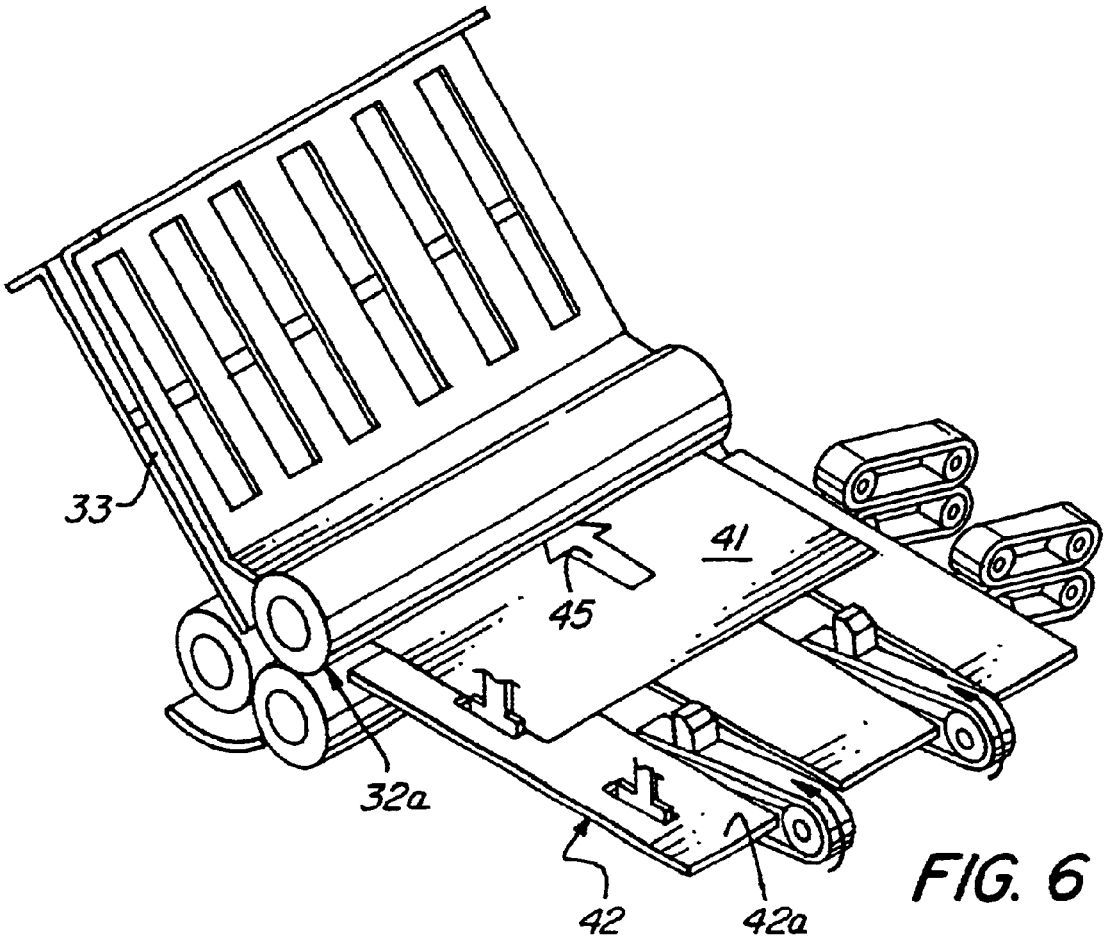
Figure 7:
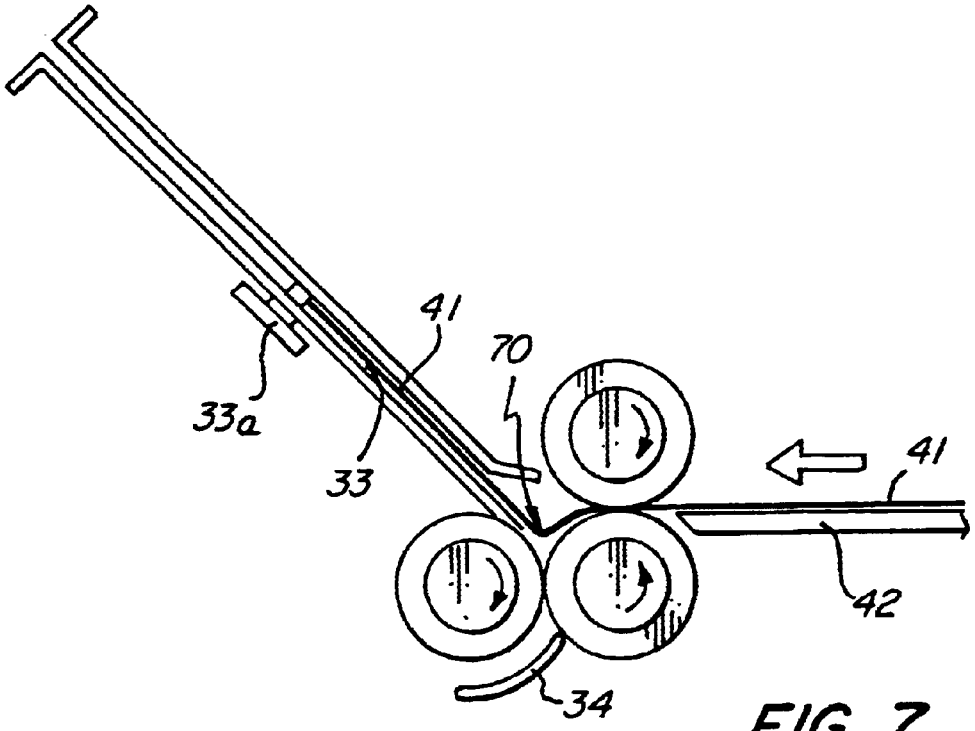

Referring now to FIG. 3, inside the RAFT module 10, the chute pusher 23 is shown propelling the accumulated stack of sheets along a chute guide 31, to a chute feed nip 32*a*. A nip is in general provided by two counter-rotating cylinders or discs disposed so as to have parallel axes of rotation and to have their rotating surfaces meet along a line of contact. When a sheet or a stack of sheets is fed into the line of contact, i.e. between the two counter-rotating cylinders or discs, the stack of sheets is grabbed or nipped and pulled through the line of contact. In the case of the chute feed nip 32*a*, a stack of sheets to be included in an envelope is pulled through the line of contact corresponding to the chute feed nip 32*a* and into a buckle chute 33. Referring now also to FIGS. 4–7, as the stack 41 continues to be pulled through the chute feed nip 32*a*, it strikes a stop 33*a*. However, the chute feed nip 32*a* continues to drive the stack 41 into the buckle chute 33, the stack 41 buckles along a buckle line 70 (FIG. 7). Because of the action of the chute feed nip 32*a* continuing to feed paper into the buckle chute 33, the buckle line 70 moves toward a folder nip 32*b*.

Figure 8:
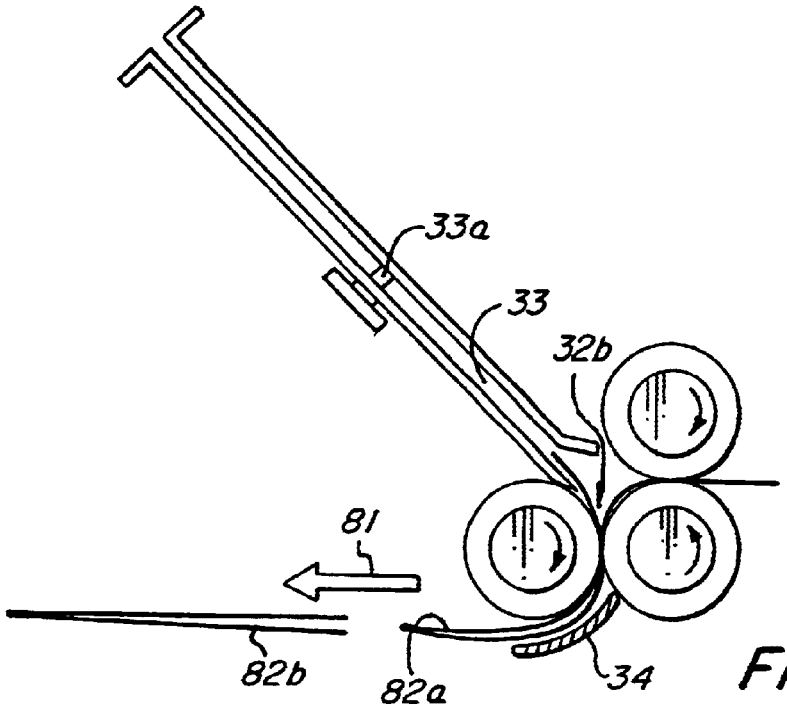
Figure 9:
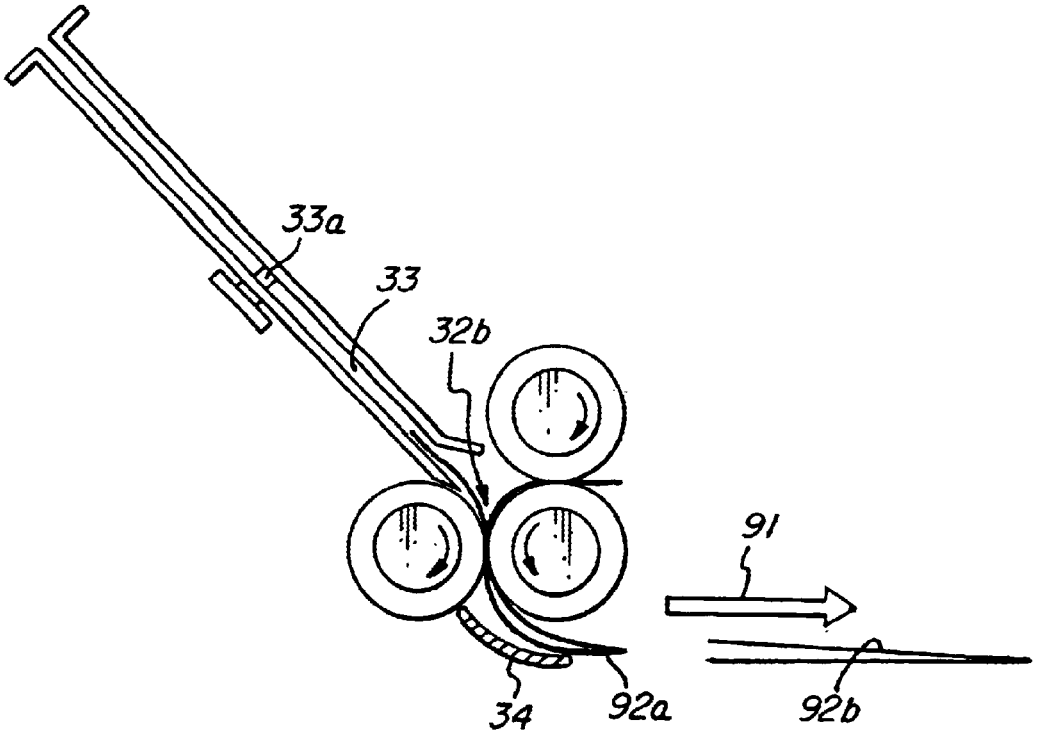

Referring now to FIGS. 8 and 9, a diverter 34 next directs a stack in either of two opposite directions. FIG. 8 shows a stack of sheets 82*a* in the course of being pulled by the folder nip 32*b* toward the diverter 34 and moving in a direction 81 following an already folded stack of sheets 82*b*. FIG. 9 shows a stack of sheets 92*a* being pulled through the folder nip 32*b* and diverted by the diverter 34 so as to move in an opposite direction 91 following another stack of sheets 92*b*.

Referring again to FIGS. 4–6, the feeding of the stack of sheets 41 into the buckle chute 33 is shown in more detail, beginning with the stack of sheets 41 moving in the direction indicated by arrow 43 (FIG. 4) under the action of a feed path nip 40 onto the surface of a turnplate 42 through which the stops 20 protrude. The stack of sheets 41 continues in the direction indicated by arrow 44 (FIG. 5) until striking the stops 20. Then the chute pushers 23 drive the stack of sheets 41 in the direction indicated by arrow 45 (FIG. 6) into the chute feed nip 32*a*.

Referring again to FIGS. 8 and 9, in the preferred embodiment, the diverter 34 is caused to rotate so as to assume a position that will guide a stack of sheets in the direction indicated by either arrow 81 (FIG. 8) or arrow 91 (FIG. 9) depending on bar codes provided with a sheet in the stack of sheets 82*a* 92*a*. A bar code reader 12 (FIG. 1*a*) is disposed within the RAFT module so as to properly orient the diverter 34, according to such a bar code.

Figure 10:
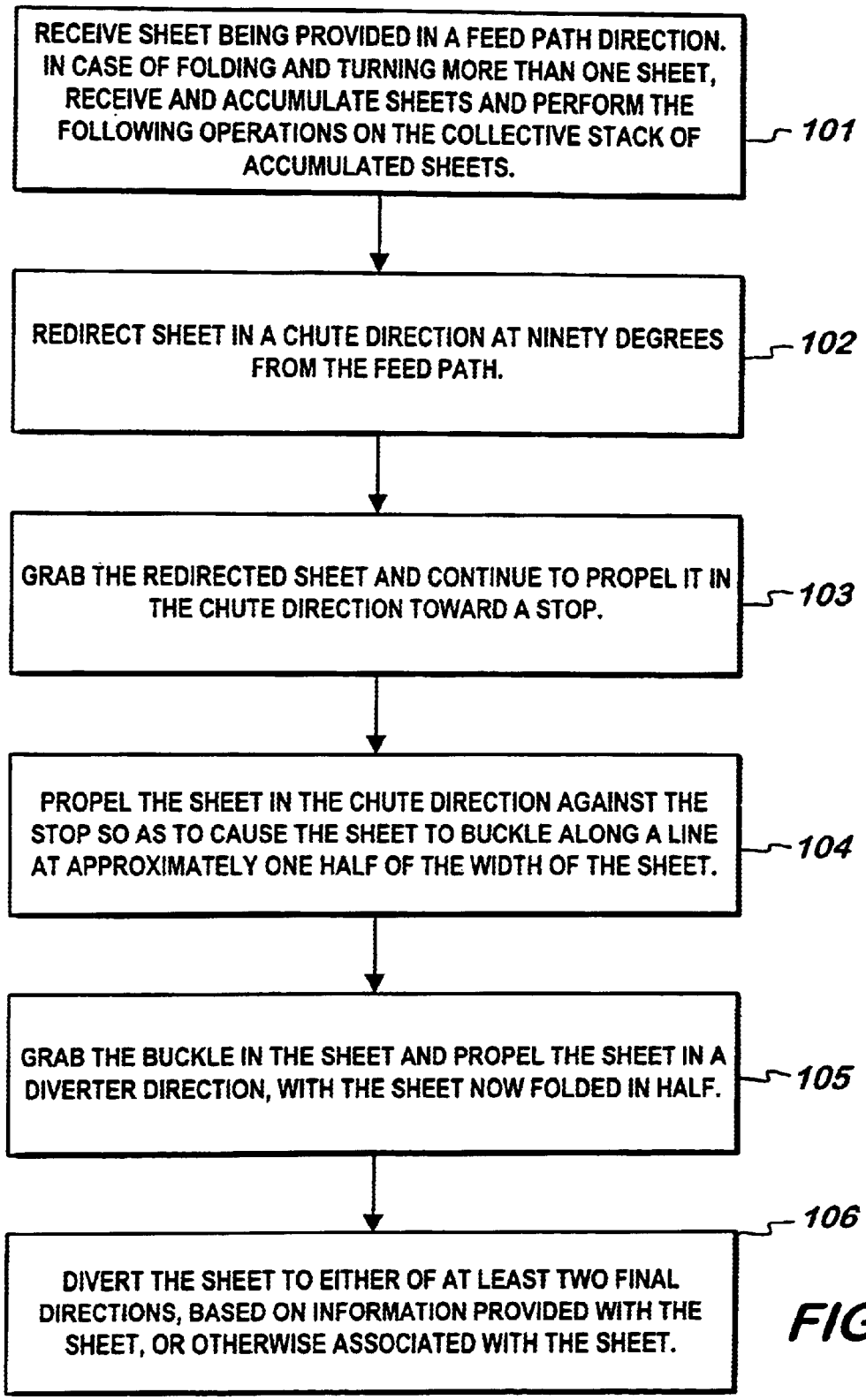
FIG. 10 is a flow chart indicating the steps of the method of the present invention for folding a sheet (or a stack of sheets), after receiving the sheet (or a series of sheets) from a feed direction, and providing the folded sheet (or the folded stack of sheets) in a different, final direction.

Referring now to FIG. 10, a flow chart is shown indicating a method according to the present invention for folding and turning sheets as part of the operation of the mailing system. The method is for either receiving a single sheet provided in a feed direction, turning it and then providing it in a final different direction; or for receiving a series of sheets and accumulating the sheets in a stack of sheets, folding the stack of sheets collectively, and providing the folded stack of sheets in a final direction different from the feed direction.

The method includes a first step 101 in which a series of sheets is received, as it is provided in a feed path direction, and accumulated into a stack of sheets. In the next step 102, the stack of sheets is redirected in a chute direction at 90° from the feed path. Next, in a step 103, the redirected stack of sheets is grabbed (by a nip) and propelled so as to continue in the chute direction toward a stop in the chute. Then, in a step 104, the stack of sheets is propelled against the stop, causing the stack of sheets to buckle along a line located at approximately half way across a width of the stack of sheets. In a next step 105, the buckle in the stack of sheets is grabbed (and the stack of sheets is propelled in a diverter direction, with the stack now folded in half). Finally, in a step 106, the stack is diverted to either of at least two final directions, based on information provided with a sheet in the stack, or otherwise associated with the stack.

As indicated above, in the preferred embodiment the information about whether to divert a stack is provided by a bar code on a sheet in the stack, the bar code being read by a bar code reader 12 (FIG. 1). A stack can also be diverted to one or the other of at least two final directions based on the color of a sheet in the stack, or upon the weight of a sheet in the stack, with sensors used to sense the distinguishing characteristic in each case.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. An apparatus for folding and selective, multi-directional, multi-path, right angle turning of a sheet fed from a feed conveyor along a feed path, the apparatus comprising:

a) a turnplate for receiving the sheet, the turnplate having stops protruding from a sheet-receiving surface of the turnplate, for holding the sheet edge aligned against the stops;

b) a chute pusher disposed so as to have a pusher tab movable across the sheet-receiving surface of the turnplate, for pushing the sheet along the sheet-receiving surface of the turnplate in a chute direction at substantially ninety degrees from the feed path;

c) a chute feed flip, disposed at the edge of the turnplate toward which the pusher tab pushes, for grabbing the sheet and driving it onward in the chute direction;

d) a chute, disposed so as to receive the sheet being provided in the chute direction by the chute feed nip, the chute having a chute stop disposed a distance along the chute approximately equal to a half-width of the sheet, for continuing to receive the sheet until it stops at the chute stop and then to provide a buckle in the sheet that is caused to protrude from the chute under the continuing action of the chute feed nip, until the sheet is clear of the chute feed nip;

e) a folder nip, disposed to grab the buckle in the sheet, for providing the sheet folded in half;

f) a diverter, rotatably disposed to receive the sheet folded in half, for directing the sheet upon exit from the apparatus to either of two opposite directions substantially orthogonal to the feed path, depending on the orientation of the diverter; and g) a main path conveyor and an alternative path conveyor for respectively transporting sheets in the two opposite directions, as directed by the diverter, the main path conveyor and the alternative path conveyor transporting sheets to different downstream processing stations.

2. An apparatus as in claim 1, further comprising a means for acquiring information about whether to divert the sheet, and wherein the diverter is rotated into an orientation depending on the acquired information.

3. An apparatus as in claim 2, wherein the means for acquiring information about whether to divert the sheet is a bar code reader disposed so as to be able to read a bar code on the sheet.

4. A method for providing alternate processing paths for accumulated, folded, and reoriented sheets fed from a feed conveyor along a feed path, the method comprising:

a) accumulating a plurality of sheets b) redirecting the sheets in a chute direction at substantially ninety degrees from the feed path;

c) grabbing the redirected sheets, continuing to propel them in the chute direction, pushing them against a stop and so causing the sheets to form a buckle along a line located approximately halfway across a width of the sheets and extending along a length of the sheet;

d) grabbing the buckle in the sheets and propelling the sheets in a diverter direction, the sheets folded in half;

e) directing the folded sheets to alternate processing paths by diverting the sheets, upon completion of folding, to either of two opposite directions substantially orthogonal to the feed path; and f) transporting the folded sheets on the alternate processing paths to different downstream processing stations.

5. A method as in claim 4, further comprising the step of acquiring information indicating whether to divert the sheets from a main processing path direction to an alternative processing path direction, and wherein in the step of diverting the sheet, the diverting is based on the acquired information.

6. A folding apparatus for accumulating and directionally reorienting the movement of sheets fed from a feed conveyor along a first direction, the apparatus comprising:

an accumulator for receiving the fed sheets in the first direction, the accumulator having a mechanism for accumulating a plurality of fed sheets and feeding the accumulated sheets in a second direction, the second direction being substantially orthogonal to the first direction; and a folder located adjacent the accumulator and in the path of the travel of the second direction, the folder including:

a mechanism for folding the accumulated sheets conveyed into it from the accumulator;

first and second output paths for conveying a folded accumulation of sheets away from the folding apparatus, the first output path conveying the folded accumulation of sheets in the second direction and the second output path conveying the folded accumulation of sheets in a third direction, the third direction being substantially opposite of the second direction and substantially orthogonal of the first direction; and a diverting mechanism for selectively diverting the folded accumulation of sheets from the folding mechanism to one of the first and second output paths.

7. A folding apparatus as recited in claim 6, wherein the accumulator includes a turnplate for receiving the sheets in the first direction from the conveyor, the turnplate having stops protruding from a sheet-receiving surface of the turnplate for holding a sheet edge aligned against the stops.

8. A folding apparatus as recited in claim 7, wherein the accumulator further includes a chute pusher disposed so as to have a pusher tab movable across the sheet-receiving surface of the turnplate to push a sheet along the sheet-receiving surface of the turnplate in the second direction.

9. A folding apparatus as recited in claim 8, wherein the accumulator further includes a chute feed nip disposed at the edge of the turnplate toward which the pusher tab pushes to grab the sheet and drive it in the second direction toward the folder.

10. A folding apparatus as recited in claim 9, wherein the folder further includes a chute to receive the sheet being provided by the chute feed nip, the chute having a chute stop disposed a distance along the chute approximately equal to a half-width of the sheet, the chute continuing to receive the sheet until the sheet stops at the chute stop and forms a buckle that is caused to protrude from the chute under the continuing action of the chute feed nip until the sheet is clear of the chute feed nip.

11. A folding apparatus as recited in claim 10, wherein the folder further includes a folder nip, disposed to grab the buckle in the sheet, for providing the sheet folded in half.

12. A folding apparatus as recited in claim 11, wherein the diverting mechanism includes a diverter, rotatably disposed to receive the sheet folded in half, for directing the sheet to either of two opposite directions, depending on the orientation of the diverter.

13. A folding apparatus as recited in claim 12, further comprising a means for acquiring information about whether to divert the sheet, and wherein the diverter is rotated into an orientation depending on the acquired information.

14. A folding apparatus as recited in claim 13, wherein the means for acquiring information about whether to divert the sheet is a bar code reader disposed so as to be able to read a bar code on the sheet.

* * * * *